United States Patent [19]

Katsube

[11] 4,157,127

[45] Jun. 5, 1979

[54] FIRE ESCAPE

[76] Inventor: Akinaga Katsube, 4-9-16-5, Sakuracho, Hatogaya, Saitama, Japan

[21] Appl. No.: 835,954

[22] Filed: Sep. 23, 1977

[51] Int. Cl.[2] ..... A62B 1/12

[52] U.S. Cl. ..... 182/5; 188/65.5; 254/156; 254/158

[58] Field of Search ..... 182/5, 6, 7, 71, 191, 182/192, 10; 188/65.4, 65.5; 254/158, 172, 156

[56] References Cited

U.S. PATENT DOCUMENTS

| | | | |
|---|---|---|---|
| 305,950 | 9/1884 | Morrison | 254/158 |
| 537,383 | 4/1895 | Buckelew | 254/158 |
| 682,869 | 9/1901 | Hammerly | 188/65.5 |
| 3,946,989 | 3/1976 | Tsuda | 182/5 |

*Primary Examiner*—Reinaldo P. Machado

*Attorney, Agent, or Firm*—Oblon, Fisher, Spivak, McClelland & Maier

[57] ABSTRACT

This invention relates to a fire escape which has a base member, a brake device, a flexible elongated member for holding escaping persons and a drive device having at least one drive wheel which drives the brake device by frictional engagement with the flexible elongated member. The fire escape includes an actuator which is pivotally supported by the base member and acts to press the flexible elongated member at the entry side thereof toward the drive wheel to a contacting member disposed on the base member so as add a brake force to the flexible elongated member and to create a tension force in the flexible elongated member by receiving a force from the flexible elongated member at the exit side thereof from the drive wheel owing to a total weight of escaping persons held by the flexible elongated member.

6 Claims, 11 Drawing Figures

FIRE ESCAPE

BACKGROUND OF THE INVENTION

1. Field of the Invention

This invention relates to a fire escape, and more particularly to a fire escape having a flexible elongated member which frictionally engages with wheel or wheels for driving a brake device.

2. Description of the Prior Art

In the past, various fire escapes of such kind have been developed. But, no fire escape makes it possible that continuous descents of many escaping persons in a short time can be accomplished. In this regard, a large capacity brake device is necessary for holding many escaping persons by a flexible elongated member at a same time.

SUMMARY OF THE INVENTION

Accordingly, an object of this invention is to provide a fire escape which enables reduction of the capacity of a brake device and makes it possible for many escaping persons to be held by a flexible elongated member at the same time, whereby continuous descent of many escaping persons in a short period of time can be accomplished.

Another object of this invention is to provide a fire escape which has a simple mechanism which enables the reduction of the capacity of a brake device to avoid slip of a flexible elongated member along a wheel or wheels for driving the brake device.

The foregoing and other objects are achieved by this invention through the provision of a fire escape which has a base member, a brake device mounted to the base member, a flexible elongated member for hold of escaping persons and a drive device mounted to the base member which includes at least one drive wheel for drive of the brake device by frictional engagement with the flexible elongated member. The fire escape comprises an actuator which is pivotally supported by the base member and acts to press the flexible elongated member at coming side thereof toward the drive device to a contacting member apart from the drive device by receiving a force from the flexible elongated member at leaving side thereof from the drive device owing to a total weight of escaping persons held by the flexible elongated member, whereby the flexible elongated member receives a brake force substantially proportional to a total weight of escaping persons at the entry side thereof toward the drive device by the actuator and a tension force which has the same strength as the brake force created in the flexible elongated member. The actuator may act to press the flexible elongated member to the contacting member by a larger force than a total weight of escaping persons held by the flexible elongated member. The tension force created in the flexible elongated member may be more than a half of the total weight of escaping persons held by the flexible elongated member.

BRIEF DESCRIPTION OF THE DRAWINGS

Various other objects, features, and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
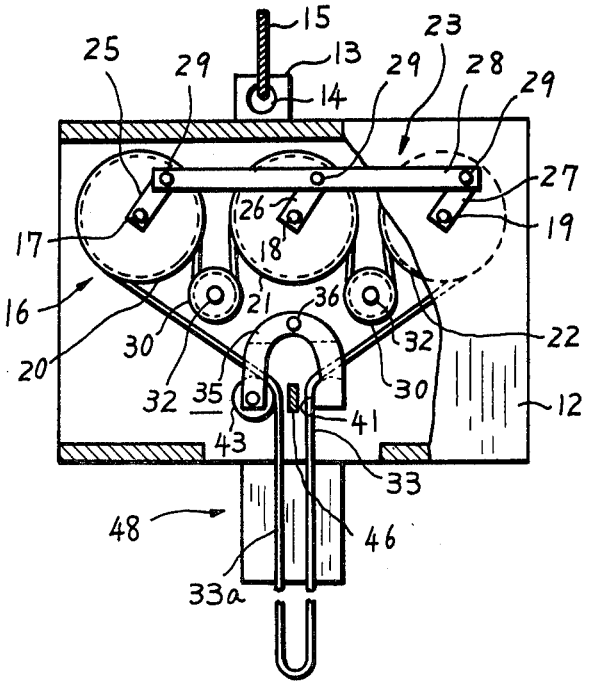
FIG. 1 is a front elevational view of a preferred embodiment of this invention partially cut-away.

Referring now to the drawings, and more particularly to FIGS. 1–5 thereof, there is shown a fire escape of a preferred embodiment of this invention.

Figure 2:
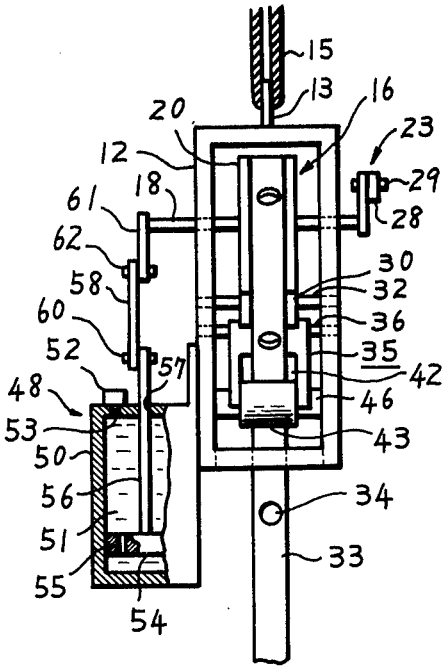
FIG. 2 is a side elevational view of the embodiment partially cut-away.
Figure 3:
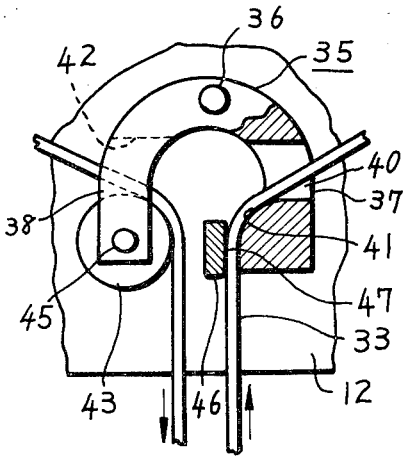
FIG. 3 is a fragmental front view showing an actuator of the embodiment during use.

Referring to FIGS. 1–3, the fire escape includes a base member 12 having an upwardly projected part or hanging part 13 which has a hole 14 so as to connect a hanging member 15 for the hanging of the fire escape.

Reference numeral 16 generally designates a drive device which has three shafts 17, 18 and 19 rotatably journaled by the base member 12. Drive wheels 20, 21 and 22 are fixed to the shafts 17, 18 and 19, respectively, and each have the same diameter. The drive device includes an equal circumferential velocity device 23 which has cranks 25, 26 and 27 fixed to the outer ends of the shafts 17, 18 and 19, respectively, and disposed in parallel with each other. A link 28 is rotatably connected to the cranks 25, 26 and 27 by pins 29. Therefore, the drive wheels 20, 21 and 22 can be rotated with equal rotating velocity or equal circumferential velocity with each other. A pair of guide wheels 30 are secured to shafts 32 which are rotatably journaled by the base member 12, respectively. A flexible elongated member or an endless belt 33 which has a plurality of longitudinally spaced holes 34 is installed around the drive wheels 20, 21 and 22 and the guide wheels 30 as best seen in FIG. 1. The three drive wheels 20, 21 and 22 connected by the equal circumferential velocity device 23 effective deter slip of the belt 33 by creating a large total frictional force between the belt 33 and the drive wheels 20, 21 and 22.

An actuator 35 which has a shaft 36 pivotally supported by the base member 12 and a pair of downwardly elongated portions 37 and 38 at both sides thereof is shown. The elongated portion 37 has a passage 40 for the belt 33 and a pressing surface 41. The portion 38 has a passage 42 for the belt 33. A roller 43 is rotatably mounted to an axel 45 at the lower end of the portion 38. A contacting member 46 is mounted to the base member 12 apart from the drive device 16 and has a contacting surface 47. The pressing surface 41 and the contacting surface 47 are disposed so as to face each other and provide a space for the passing of the belt 33 between them.

Reference numeral 48 generally designates a brake device having a vertically elongated cylinder 50 filled with liquid 51, such as oil or the like. A plug 52 is releasably engaged to a threaded opening 53 at the upper end surface of the cylinder 50 so as to supply liquid 51 in the cylinder 50. A piston 54 having a hole 55 for passing the liquid 51 therethrough is installed in the cylinder 50, and is provided with a piston rod 56 which is upwardly elongated through a hole 57 at the upper end surface of the cylinder 50. A link 58 is pivotally connected to the uppermost portion of the piston rod 56 by a pin 60 at one end thereof, and the other end of the link is rotatably connected to a crank 61 which is fixed to the shaft 18 at an opposite end thereof against the crank 26 by a pin 62.

When the drive wheels 20, 21 and 22 are rotated, the piston 54 reciprocates in the cylinder 50 and the liquid 51 flows through the hole 55, whereby the kinetic energy which is exerted from the drive wheels 20, 21 and 22 is consumed as heat energy of the liquid 51. The consumed energy is similarly proportional to the square of the rotating velocity of the drive wheels 20, 21 and 22.

Figure 4:
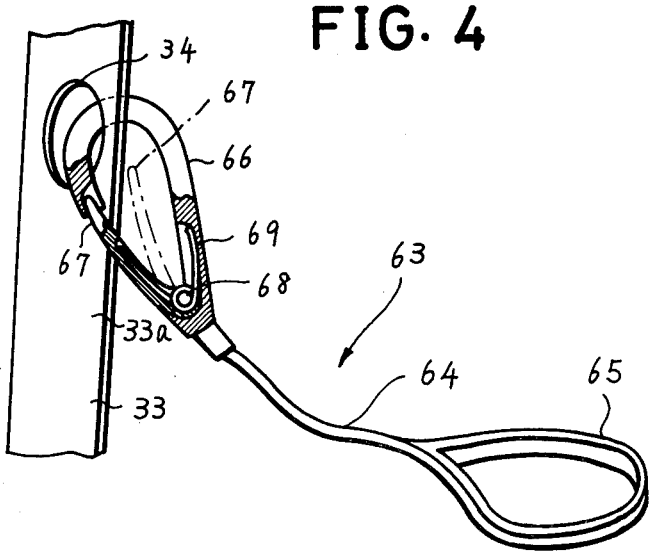
FIG. 4 is a partially cut-away perspective view of a holder of the embodiment.

Referring to FIG. 4, there is shown a holder 63 having a band member 64 which has an annular portion 65 for retaining an escaping person and includes a hook 66. A locking member 67 is pivotally connected to the hook 66 by a pin 68 and biased by a spring 69 so as to close releasably the end portion of the hook 66. The holder 63 can be engaged to the belt 33 at one side **33*a* thereof by pivoting the locking member 67 against the spring 69 as shown in chain-line, passing the end portion of the hook 66 through one of the holes 34 of the belt and releasing the locking member 67**.

Figure 5:
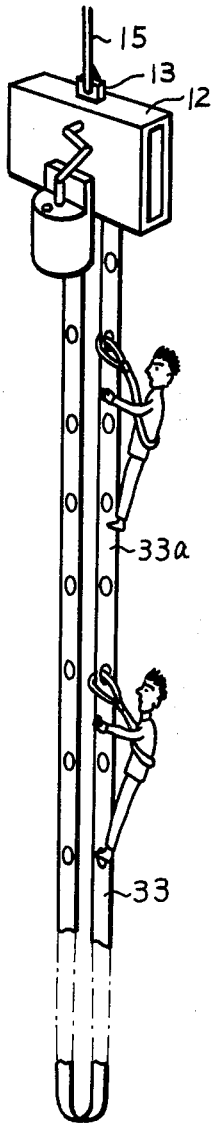
FIG. 5 is a perspective view of the embodiment during use thereof.
Figure 6:
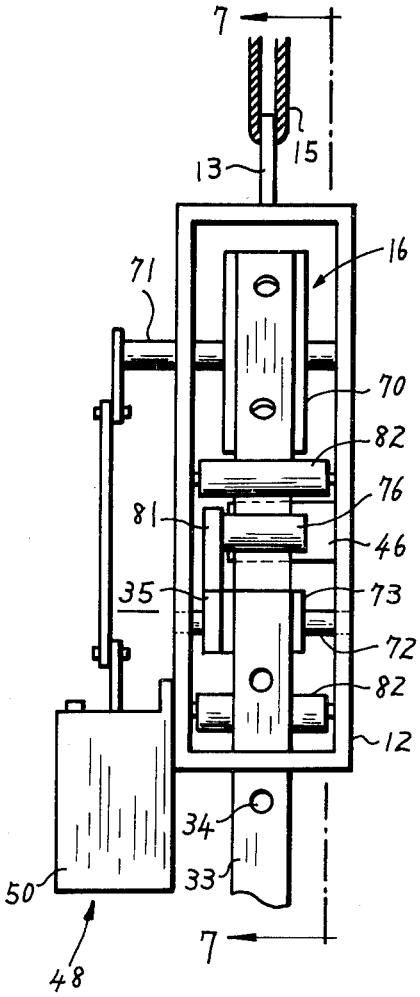
FIG. 6 is a partially cut-away side elevational view of another embodiment of this invention.

Referring to FIG. 5, in an emergency condition, escaping persons engaging their bodies to the holders 63 can be held by one side **33*a* of the belt 33 one by one. The belt is slowly moving, because the brake device 48 brakes the velocity of the belt 33. The actuator 35 has a force exerted thereon at the roller 43 from a flexed portion of the belt 33 owing to the total weight of the escaping persons held by the belt 33 so as to pivot about shaft 36. Therefore, the pressing surface 41 presses the belt 33 to the contacting surface 47, whereby the belt 33 receives a brake force which is substantially proportional to the total weight of the escaping persons held by the belt 33 by the frictional force between the belt 33 and the pressing surface 41 and the frictional force between the belt 33 and the contacting surface 47. The brake force creates a tension force which has the same strength as the brake force in the entry side of the belt 33 toward the drive device 16. The tension force creates a large total frictional force between the belt 33 and the drive wheels 20, 21, 22, and thus, a slip of the belt 33 along the drive wheels can be avoided. The brake force and the contacting surface 47 has a brake effect on the movement of the belt 33 and enables a reduction of the capacity of the brake device 48**.

Another embodiment of this invention is shown in FIGS. 6–9. A base member 12 has a hanging part 13 so as to connect a hanging member 15 to a portion **13*a* or a portion 13*b* thereof. A drive device 16 of this embodiment has only one drive wheel 70 having a shaft 71 rotatably journaled by the base member 12 and connected to a brake device 48 which has the same construction as that of the embodiment shown in FIGS. 1–5** and operates by the same method with the preceding embodiment.

An actuator 35 has a pivot shaft 72 pivotally supported by the base member 12 and four rollers 73, 74, 75, 76 rotatably installed thereto by axels 77, 78, 79, 80, respectively. The rollers 73 and 74 are disposed at opposite ends of the actuator 35. The rollers 75 and 76 are disposed at central upwardly elongated portion 81 of the actuator 35 so as to be disposed apart from each other. The lengths from the pivot shaft 72 to the axels 77 and 78 are equal and twice the lengths from the pivot shaft 72 to the axels 79 and 80, which are equal of each other.

Figure 7:
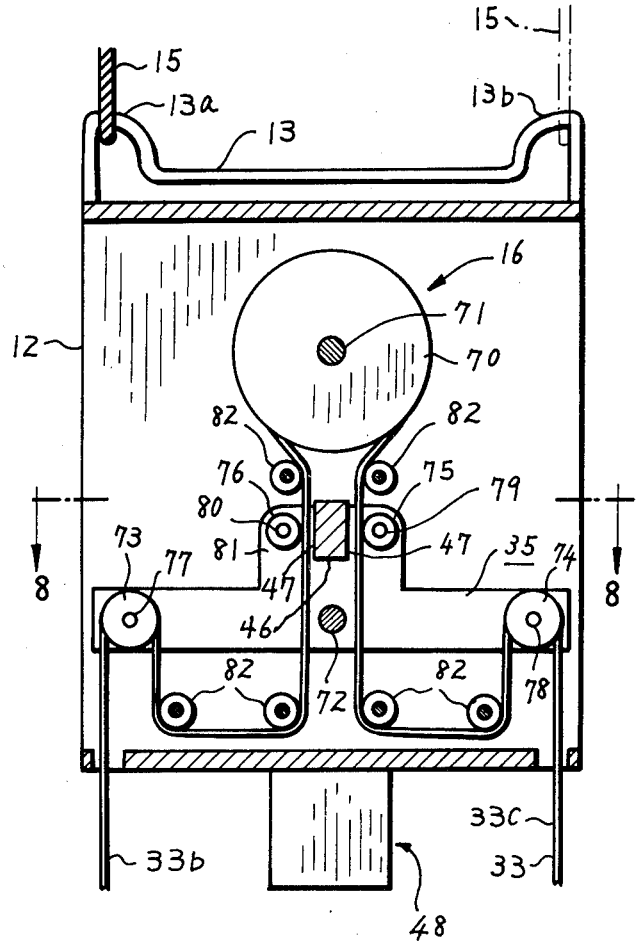
FIG. 7 is a sectional view taken along the line 7—7 of FIG. 6.

Six guide rollers 82 are installed in the base member 12 as best seen in FIG. 7. A contacting member 46 having contacting surfaces 47 at both sides thereof is mounted to the base member 12 so as to project between the rollers 75 and 76. A flexible elongated member or an endless belt 33 having a plurality of longitudinally spaced holes 34 is installed around the drive wheel 70 and the rollers 73, 74, 75, 76 and the guide rollers 82 as best seen in FIG. 7. All escaping persons can be held by only one side of the belt 33, a side **33*b* or the other side 33*c*, at a same time. The hanging member 15 is connected to a portion 13*a* or a portion 13*b* of the hanging part 13, when escaping persons held at the side 33*b* or the side 33*c***, respectively.

When escaping persons are held by the same method with the preceding embodiment to the side **33*b* of the belt 33, the actuator 35 receives a force which is about twice of a total weight of the escaping persons at the roller 73 because the belt 33 is parallel at both sides of the roller 73. Therefore, the actuator 35 pivots a small angle and presses the belt 33 by the roller 75 against the contacting member 46 with a force which is about four times of a total weight of the escaping persons held by the flexible elongated member 33. A large frictional force which is usually more than a half of a total weight of escaping persons held by the belt 33 is created between the belt 33 and the contacting member 46. Thus, this embodiment more effectively deters slip of the belt 33 along the drive wheel 70 and reduces the capacity of the brake device 48** than the preceding embodiment.

Figure 10:
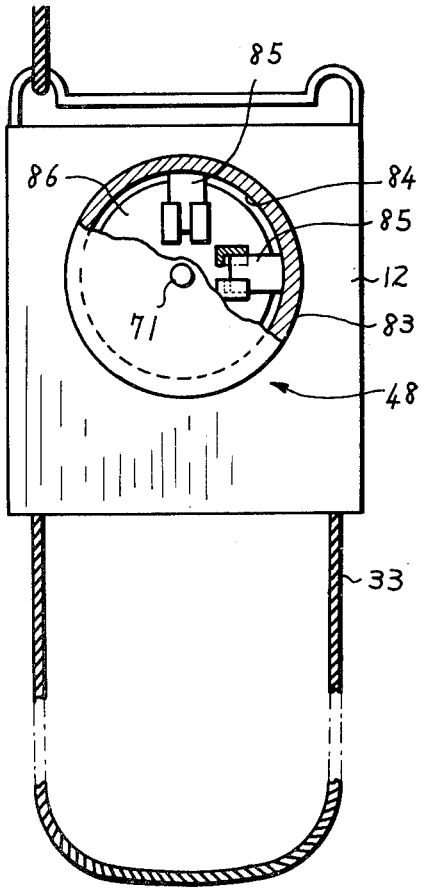
FIG. 10 is a partially cut-away rear elevational view of another embodiment of this invention.

Referring to FIG. 10, there is shown another embodiment of this invention which is a modification of the embodiment shown in FIGS. 6–9. This embodiment has a brake device 48 which has a cylindrical member 83 fixed to a base member 12 and has an inner contacting surface 84. The brake device also has a plurality of weights 85 movably installed to a plate 86 which is fixed to a shaft 71 of a driving wheel (not shown). A flexible elongated member 33 is a endless rope, to which escaping persons are to be held by their direct grasping. When the shaft 71 is rotating, the weight of each person causes pressing of the contacting surface 84 owing to a centrifugal force. A total frictional force created between the contacting surface 84 and the weights 85 brakes the velocity of the rope 33 or the descending velocity of the escaping persons.

Figure 11:
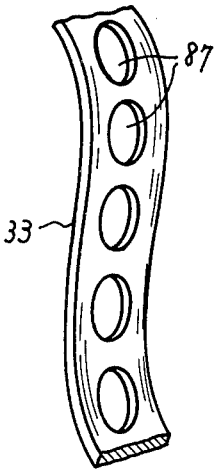
FIG. 11 is a fragmental view of a modified flexible elongated member.
Figure 8:
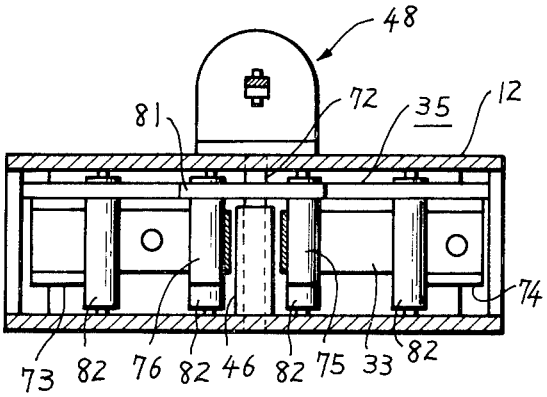
FIG. 8 is a sectional view taken along the line 8—8 of FIG. 7.
Figure 9:
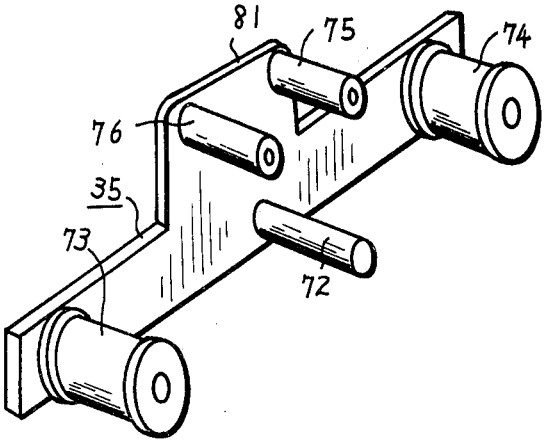
FIG. 9 is a perspective view of an actuator of the embodiment shown in FIGS. 6–8.

Referring to FIG. 11, there is shown a part of a modified flexible elongated member or a belt 33 which has many large holes 87. Escaping persons are held to the belt in this embodiment by their direct grasping thereto.

The foregoing is of course considered as illustrative only of the principle of the invention. Obviously, numerous modifications and variations of the present invention are possible in light of the above teachings. The fire escape as shown in FIGS. 6–9 may have a flexible elongated member 33 which is not endless type and have a pluraity of holders at both ends thereof, respectively, for holding escaping persons and allowing for reciprocative movement.

What is claimed as new and desired to be secured by Letters Patent of the United States is:

1. In a fire escape having a base member, a brake device mounted to the base member, a flexible elongated member for holding a plurality of escaping persons and a drive device having at least one drive wheel which drives the brake device by frictional engagement with the flexible elongated member, wherein said fire escape comprises:

a contacting member mounted on said base member and apart from said drive device;

an actuator which is pivotally supported by said base member and acts to press said flexible elongated member at an entry side thereof toward said drive device to engage said contacting member disposed on said base member by receiving a force from said flexible elongated member at an exit side thereof from said drive device owing to a total weight of said escaping persons held by said flexible elongated member, wherein said flexible elongated member receives a brake force substantially proportional to the total weight of the escaping persons at the entry side thereof toward said drive device by said actuator and a tension force which has the same strength as the brake force created in said flexible elongated member.

2. A fire escape as set forth in claim 1, wherein said actuator acts to press said flexible elongated member to said contacting member by a larger force than a total weight of escaping persons held by said flexible elongated member.

3. A fire escape as set forth in claim 2, wherein said tension force in said flexible elongated member is more than half of the total weight of escaping persons held by said flexible elongated member.

4. A fire escape as set forth in claim 1, wherein said actuator comprises:

a first and second elongated portion and, a roller mounted to said first elongated portion wherein said second elongated portion includes an opening through which said flexible elongated member passes and a pressing surface which cooperates with said contacting member to brake said flexible elongated member.

5. A fire escape as set forth in claim 1, wherein said actuator includes a central elongated portion and a first and second roller mounted on said central elongated portion of said actuator and adjacent said contacting member for engaging said contacting member.

6. A fire escape as set forth in claim 1, wherein said brake member includes a cylindrical member fixed to said base member having an inner contacting surface and a plurality of weights mounted on said shaft for frictionally contacting said cylindrical member.

* * * * *

UNITED STATES PATENT AND TRADEMARK OFFICE

CERTIFICATE OF CORRECTION

PATENT NO. : 4,157,127

DATED : June 5, 1979

INVENTOR(S) : AKINAGA KATSUBE

It is certified that error appears in the above-identified patent and that said Letters Patent are hereby corrected as shown below:

Please change the inventor's address as Follows:

[76] -- 5-15-8, Daitakubo, Urawa, Saitama 336, Japan --

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*